US005153086A

United States Patent [19]

Yagi et al.

[11] Patent Number: 5,153,086

[45] Date of Patent: Oct. 6, 1992

[54] ELECTROPHOTOGRAPHIC PHOTORECEPTOR WITH CHARGE TRANSPORT LAYER OF SILICON OXIDE, CARBIDE OR NITRIDE AND TRANSITION METAL

[75] Inventors: Shigeru Yagi; Masao Watanabe, both of Kanagawa, Japan

[73] Assignee: Fuji Xerox Co., Ltd., Tokyo, Japan

[21] Appl. No.: 648,790

[22] Filed: Feb. 1, 1991

[30] Foreign Application Priority Data

Feb. 2, 1990 [JP] Japan ..... 2-22009

[51] Int. Cl.[5] ..... G03G 5/047

[52] U.S. Cl. ..... 430/58; 430/66

[58] Field of Search ..... 430/58, 60, 66

[56] References Cited

U.S. PATENT DOCUMENTS 4,733,482 3/1988 West et al. ..... 357/23.5
4,876,168 10/1989 Hotomi et al. ..... 430/58
5,041,350 8/1991 Yagi ..... 430/58

*Primary Examiner*—Roland Martin
*Attorney, Agent, or Firm*—Finnegan, Henderson, Farabow, Garrett and Dunner

[57] ABSTRACT

An electrophotographic photoreceptor essentially comprising a substrate having thereon a charge transporting layer and a charge generating layer is disclosed, wherein said charge transporting layer comprises at least one of silicon oxide, silicon carbide, and silicon nitride and contains a transition metal element. The photoreceptor exhibits stable electrophotographic characteristics on repeated use and prolonged durability.

7 Claims, 1 Drawing Sheet

ELECTROPHOTOGRAPHIC PHOTORECEPTOR WITH CHARGE TRANSPORT LAYER OF SILICON OXIDE, CARBIDE OR NITRIDE AND TRANSITION METAL

FIELD OF THE INVENTION

This invention relates to an electrophotographic photoreceptor and, more particularly, to a charge transporting layer of an electrophotographic photoreceptor having a function separated type photosensitive layer.

BACKGROUND OF THE INVENTION

A so-called function separated type electrophotographic photoreceptor has a photosensitive layer composed of a charge generating layer capable of generating a photo carrier on exposure to light and a charge transporting layer capable of efficiently transporting the thus-generated photo carrier. Charge transporting materials which have hitherto been employed include organic materials, such as high-molecular weight compounds (e.g., polyvinylcarbazole) and high-molecular weight resin binders (e.g., polycarbonate) having dispersed or dissolved therein low-molecular weight compounds (e.g., pyrazoline and triphenylamine); and inorganic materials, such as chalcogen compounds (e.g., selenium and selen-tellurium).

However, electrophotographic photoreceptors using these conventional charge transporting materials have disadvantages such that electrical characteristics such as chargeability, dark decay, residual potential, and the like are instable against repeated use and that the photosensitive layer has insufficient mechanical strength, i.e., hardness or adhesion, and is liable to receive scratches in a copying machine or undergo layer separation. Therefore, the photoreceptors have difficulty in producing satisfactory copies for a long time in a stable manner, and their working life (durability) has been limited to thousands to tens of thousands of copies.

Where a surface layer or an adhesive layer is additionally provided to overcome these problems, the structure of a photosensitive layer becomes overly complicated, rather resulting in an increase of defects during production of the photoreceptor.

Further, electrophotographic photoreceptors using organic charge transporting materials are inferior in transporting performance, particularly potential decay in a low temperature environment, and, also, unsuitable for high-speed copying.

Furthermore, electrophotographic photoreceptors using conventional charge transporting materials have insufficient stability to heat or light and easily undergo deterioration such as crystallization or degradation of low-molecular weight compounds. It has thus been necessary to control the conditions or environment in which the photoreceptors are used or stored.

In function separated type electrophotographic photoreceptors having a charge transporting layer on a part of a photoconductive layer, the charge transporting layer generally has a small thickness and therefore shows reduced light absorption at wavelengths near the absorption ends, that is, light passing through the charge transporting layer increases. As a result, an interference fringe unavoidably appears due to multiple reflected light from a substrate particularly when in using an infrared laser as a light source.

SUMMARY OF THE INVENTION

An object of the present invention is to provide a highly durable electrophotographic photoreceptor having a novel charge transporting layer having high adhesion, high mechanical strength or hardness, and reduced defects.

Another object of the present invention is to provide an electrophotographic photoreceptor which has high sensitivity, superior panchromatic properties, high chargeability, small dark decay, and low residual potential after exposure.

A further object of the present invention is to provide an electrophotographic photoreceptor which produces high quality images free from an interference fringe when used in a laser printer using coherent light, e.g., infrared semi-conductor laser light, as a light source.

The inventors have found that incorporation of a transition metal element into silicon oxide, silicon carbide or silicon nitride provides a charge transporting material having excellent charge transporting function and that a function separated type photoreceptor using such a charge transporting material exhibits greatly improved physical, chemical, mechanical and optical properties over those using conventional charge transporting materials, and thus reached the present invention.

The present invention relates to an electrophotographic photoreceptor essentially comprising a substrate having thereon a charge transporting layer and a charge generating layer, wherein said charge transporting layer comprises at least one of silicon oxide, silicon carbide, and silicon nitride and contains a transition metal element.

DETAILED DESCRIPTION OF THE INVENTION

Figure 1:
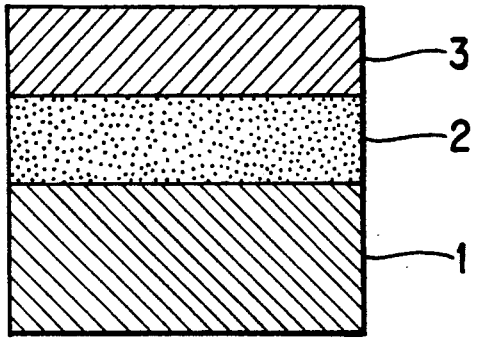
FIGS. 1 and 2 are a schematic cross section illustrating an essential structure of the electrophotographic photoreceptor according to the present invention, in which the numerals 1, 2, and 3 indicate a substrate, a charge transporting layer, and a charge generating layer, respectively.
Figure 2:
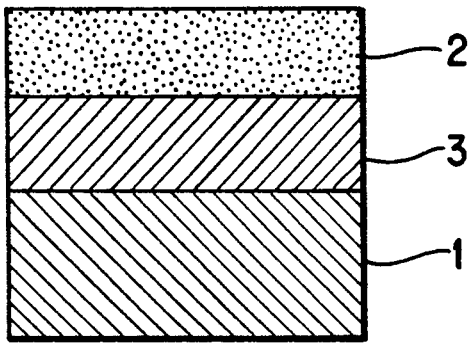
Figure 3:
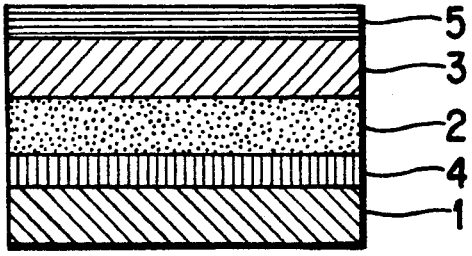
FIG. 3 is a schematic cross section illustrating one embodiment of the electrophotographic photoreceptor according to the present invention, in which the numerals 4 and 5 indicate an intermediate layer such as a charge blocking layer and a surface protective layer, respectively.

Supports which can be used in the present invention may be either electrically conductive or insulating. Suitable conductive substrates include metals and alloys, e.g., aluminum, stainless steel, nickel, and chromium. Suitable insulating substrates include films or sheets of high polymers, e.g., polyester, polyethylene, polycarbonate, polystyrene, polyamide, and polyimide; glass, and ceramics. The surface of insulating substrates at least on the side having a photosensitive layer must be rendered electrically conductive by, for example, vacuum evaporation, sputtering or ion plating of metals, such as the above-mentioned metals, gold, copper, etc. The electrophotographic photoreceptor of the invention may be irradiated with an electromagnetic wave either from the side of the support or from the side of the photosensitive layer. In the former case, when the above-mentioned metal is used for imparting conductivity, the thickness of the support should be such that permits of transmission of the electromagnetic wave. A transparent conductive film, e.g., indium-tin oxide (ITO), may be made use of for rendering the surface of a substrate conductive.

The charge transporting layer according to the present invention may be provided at a position either closer to or farther from the substrate than a charge generating layer.

In the charge transporting layer according to the present invention, charge transporting is effected through hopping conduction of photo carriers among transition metal particles present in a silicon oxide, carbide or nitride matrix. It is considered that the d atomic orbital possessed by the metallic element contributes to charge transporting. In the present invention, satisfactory charge transporting properties can be obtained when the charge transporting layer has an electrical resistance of from $10^{11}$ to $10^{16}$ Ω.cm.

The transition metal elements which are incorporated into a charge transporting layer include 3*d*, 4*d*, and 5*d* transition metal elements. Of these elements, Sc, Ti, V, Cr, Mn, Fe, Co, Ni, Cu, or Zn of 3*d* transition metal elements whose d-electrons are distributed near to the nucleus with small orbital radii and have proper directionality are particularly preferred. When these elements are incorporated into silicon compounds, the degree of overlap of atomic orbits among transition metal elements is small, and the elements are easily localized, making it easy to control dark conductivity and transporting capacity.

The charge transporting layer mainly comprising at least one of silicon oxide, silicon carbide (preferably silicon oxide), and silicon nitride can be formed by gaseous phase deposition methods such as PVD (physical vapor deposition), e.g., CVD, plasma CVD, and ion plating; or liquid phase deposition methods such as a sol-gel method and electrodeposition. A transition metal element can be incorporated into the silicon compound deposit by simultaneous deposition using a mixed raw material or by separately decomposing two raw materials on a support. It is also possible that a layer of a silicon compound is once formed and then a transition metal element is incorporated thereinto by ion striking, penetration or impregnation.

Silicon oxide to be formed suitably has an oxygen to silicon atomic ratio of from 0.1 to 2.0 and preferably from 0.2 to 2.0. Silicon carbide to be formed suitably has a carbon to silicon atomic ratio of from 0.05 to 1.0 and preferably from 0.1 to 1.0. Silicon nitride to be formed suitably has a nitrogen to silicon atomic ratio of from 0.1 to 1.3 and preferably from 0.2 to 1.3. If an atomic ratio of oxygen, carbon or nitrogen to silicon in silicon oxide, carbide or nitride is less than 0.1, electrical resistance is too low to retain sufficient quantity of charge.

The transition metal element is added in an amount of from 0.01 to 30 at. %, and preferably from 1 to 20 at. %, based on silicon. If the transition metal content is less than 0.01 at. %, the layer cannot perform an effective transporting function. If it is more than 30 at. %, the layer has too low resistance to retain sufficient quantity of charge. The incorporated transition metal element may be distributed in the silicon compound either uniformly or non-uniformly, forming secondary or tertiary particles.

A typical example of the formation of the charge transporting layer according to the present invention is described below.

In the case of plasma CVD, a vaporized silicon compound is introduced into a vacuum reactor, and an electric field is applied between two electrodes at a frequency of from 0 to 5 GHz while maintaining the inner pressure at $10^{-4}$ to $10^{-5}$ Torr to cause an electrical discharge. There is thus formed a deposit on an electrode substrate or a substrate placed on an electrode and heated to 20° to 400° C. Raw materials as a silicon source include $SiCl_4$, $SiH_4$, and $Si_2H_6$ (preferably $SiH_4$), and raw materials to be reacted with silicon to form an oxide, carbide or nitride (preferably oxide and nitride) include $O_2$, $CO_2$, $N_2O$, $CH_4$, $C_2H_6$, $N_2$, $NH_3$, and NHNH (preferably $O_2$). Raw materials for transition metal elements include organometallic compounds, e.g., $CrF_3$, $CrF_4$, $ZrF_4$, $TiF_4$, $CuF_2$, NiF, $VF_3$, $MnF_2$, $MoF_6$, $MoCl_6$, $WF_6$, $WCl_6$, $Zn(CH_3)_2$, and $Zn(C_2H_5)_2$. The organometallic compound as a transition metal element source is introduced in a gaseous phase into the vacuum reactor as a gaseous mixture with the above-described raw material gas or separately from the above-described raw material gas. If desired, a carrier gas, e.g., hydrogen, nitrogen, helium, and argon, may be used in combination.

In the case of ion plating, silicon or silicon oxide, carbide or nitride is used as a silicon source. The degree of vacuum in a vacuum chamber is set at $10^{-5}$ to $10^{-7}$ Torr The silicon source is melted and vaporized by means of an electron gun at a voltage of from 0.5 to 50 kV and a current of from 1 to 1000 mA while applying a voltage of +1 to 500 V to the ionizing electrode and a bias voltage of +0 to −2000 V to the substrate, and the evaporated atom and/or ion is reacted with an O, C or N atom, ion or molecule in an activated $O_2$, $N_2$, $CO_2$, $CH_4$, or $NH_4$ plasma by a glow discharge and the like to obtain an oxide, carbide or nitride of silicon (preferably oxide of silicon). The reaction pressure is in the range of from $10^{-6}$ to $10^{-1}$ Torr, and preferably from $10^{-4}$ to $10^{-2}$ Torr. Incorporation of a transition metal element into the produced silicon compound can be carried out by simultaneously heat-evaporating a transition metal element or a compound thereof from a separate evaporation source by means of an electron gun or a like technique. Transition metal element sources include Sc, Ti, V, Mn, Cr, Fe, Co, Ni, Cu, Zn, $TiO_2$, $ZrO_2$, $Fe_2O_3$, CoO, NiO, WC, TiC, CuO, ZrC, ScC, and TiN.

In the case of a sol-gel method, a silicon alkoxide, e.g., $Si(OCH_3)_4$, $Si(OC_2H_5)_4$, $Si(OC_3H_7)_4$ and $Si(OC_4H_9)$, is dissolved in an alcohol and hydrolyzed while stirring. The resulting sol is applied to a substrate by spraying or dip-coating. After the solvent is removed, the coating is dried by heating at 50° to 300° C. for 1 to 24 hours to obtain silicon oxide. A transition metal element can be incorporated by adding a transition metal alkoxide, e.g., $Ti(OC_3H_7)_4$, $Zr(OC_3H_7)_4$, $Y(OC_3H_7)_3Y(OC_4H_9)_3$, $Fe(OC_2H_5)_3$, $Fe(OC_3H_7)_3$, $Fe(OC_4H_9)_3$, $Nb(OCH_3)_5$, $Nb(OC_2H_5)_5$, $Nb(OC_3H_7)_5$, $Ta(OC_3H_7)_5$, $Ta(OC_2H_9)_5$, $V(OC_2H_5)_5$, and $V(OC_4H_9)_3$, or an organic transition metal complex, e.g., trisacetylacetonatoiron, bisacetylacetonatocobalt, bisacetylacetonatonickel, and bisacetylacetonatocopper, to the above-described sol.

Among these method for forming the charge transporting layer, the sol-gel method is preferred.

The thus formed silicon oxide, carbide or nitride functions like a binder resin in an organic low-molecular weight compound-dispersion type charge transporting layer. The transition metal element appears to serve as a low-molecular weight substance providing sites of charge transporting.

The thickness of the charge transporting layer is a range of from 2 to 100 μm, and preferably from 3 to 50 μm.

A charge generating layer which can be used in the present invention can be made of inorganic substances, e.g., amorphous silicon, selenium, arsenic selenide, and selen-tellurium, by CVD, vacuum evaporation, sputtering or a like technique. A charge generating layer can also be made of a thin film of dyestuffs, such as phthalocyanine, Cu-phthalocyanine, Al-phthalocyanine, V-phthalocyanine, squaric acid derivatives, merocyanine dyes, and bisazb dyes, which is formed by vapor deposition or by applying a dispersion of these dyestuffs in a binder resin by dip coating or the like method.

In particular, a charge generating layer made of hydrogenated amorphous silicon, germanium-doped hydrogenated amorphous silicon, or hydrogenated amorphous germanium exhibits excellent mechanical and electrical characteristics.

Formation of a charge generating layer using hydrogenated amorphous silicon for instance is explained below in detail.

A charge generating layer mainly comprising amorphous silicon can be formed by known methods, for example, glow discharge decomposition, sputtering, ion plating, and vacuum evaporation. While a film formation method is appropriately selected from among them according to the end use, a method comprising glow discharge decomposition of a silane gas or a silane-based gas by plasma CVD is preferred. According to this method, a film containing from 1 to 40 at. % of hydrogen and having relatively high resistance and high photosensitivity can be formed to provide a charge generating layer having suitable characteristics.

In the case of plasma CVD method, for instance, starting gas materials which can be used for preparing a charge generating layer mainly comprising silicon include silane gases, e.g., monosilane and disilane. If desired, a carrier gas, e.g., hydrogen, helium, argon, and neon, may be used. The starting gas may also contain a dopant gas, e.g., diborane ($B_2H_6$) and phosphine ($PH_3$), to incorporate impurities, e.g., boron and phosphorus, into a charge generating layer. Further, for the purpose of increasing photosensitivity, a halogen atom, a carbon atom, an oxygen atom, a nitrogen atom, etc. may be incorporated. Furthermore, for the purpose of increasing sensitivity in the longer wavelength region, elements, such as germanium and tin, may be added.

A charge generating layer preferably comprises silicon as a main component and from 1 to 40 at. %, and particularly from 5 to 20 at. %, of hydrogen. The thickness of the charge generating layer is from 0.1 to 30 μm, and preferably from 0.2 to 10 μm.

If desired, the electrophotographic photoreceptor according to the present invention may additionally have other optional layers on or beneath the set of a charge generating layer and a charge transporting layer. Such optional layers include a charge blocking layer made of a p-type semi-conductor or an n-type semi-conductor comprising amorphous silicon doped with an element of the group III or V of the periodic table, an insulating layer containing silicon oxide, silicon carbide, silicon nitride, or amorphous carbon, and a layer for controlling adhesion or electrical and image-formation characteristics which is made of a p-type semi-conductor or an n-type semi-conductor comprising amorphous silicon doped with an element of the group III or V of the periodic table, or which contains oxygen, carbon or nitrogen. The thickness of these layers is arbitrarily decided, usually of from 0.01 to 10 μm and preferably from 0.1 to 2.0 μm.

A surface protective layer may be provided in order to prevent denaturation of the surface of a photoreceptor due to corona ions. The thickness of the surface protective layer is generally from 0.1 to 10 μm and preferably from 0.5 to 5 μm.

Each of the above-described optional layers can be formed by plasma CVD method. As stated with respect to a charge generating layer, impurity elements can be incorporated, if desired, by introducing a vaporized substance containing a desired impurity element into a plasma CVD apparatus together with a silane gas to conduct glow discharge decomposition. Film forming conditions for these layers are as follows. The frequency is usually from 0 to 5 GHz, and preferably from 5 to 3 GHz; the discharge pressure is from $10^{-5}$ to 5 Torr (0.001 to 665 Pa); and the substrate heating temperature is from 100° to 400° C.

The present invention is now illustrated in greater detail by way of Examples, but it should be understood that the present invention is not deemed to be limited thereto.

EXAMPLE 1

In a glass container with a stopper (i.e., a plug) were charged 20 g of water and 50 g of ethanol, and the solution was stirred. To the solution was added 70 g of $Si(OC_3H_7)_4$, followed by stirring for 60 minutes to conduct hydrolysis. Then, 7 g of $Zr(OC_4H_9)_4$ was added thereto and mixed with stirring. After adjusting the viscosity by concentration, the mixture was dip-coated on a 2 mm thick aluminum plate and dried at a temperature increasing from 100° C. to 300° C. in three steps to form a 8 μm thick film containing Zr and mainly comprising $SiO_x$.

The aluminum plate having thereon the Zr-containing $SiO_x$ film was set in a vacuum chamber of a capacitively-coupled type plasma CVD apparatus. The substrate temperature was maintained at 250° C., and 100% silane gas ($SiH_4$) and 100 ppm (hydrogen-diluted) diborane gas ($B_2H_6$) were introduced into the chamber at a rate of 100 ml/min and 2 ml/min, respectively. After setting the inner pressure at 0.5 Torr, a high-frequency electrical power of 13.56 MHz was imposed to induce a glow discharge, and the power was maintained at 100 W. There was thus formed a 1 μm thick charge generating layer having high dark resistance which comprised so-called i-type amorphous silicon containing hydrogen and a trace amount of boron. Subsequently, the chamber was evacuated to a high degree of vacuum, and 30 sccm (i.e., standard cubic centimeter per minutes: $cm^3$/min) of $SiH_4$ and 30 sccm of $NH_3$ were introduced thereinto. A discharge was effected at a power of 50 W to form a 0.1 μm thick $SiN_x$ film. There was thus produced an electrophotographic photoreceptor having an about 9 μm thick photosensitive layer.

Electrophotographic characteristics of the resulting photoreceptor were evaluated as follows. An initial surface potential after charging to +6 kV by means of a corotron discharger was 400 V. A residual potential after exposure to light of 500 nm was 30 V. The photosensitivity was 6 erg/$cm^2$ as expressed in terms of a half-decay exposure amount (i.e., exposure required for the half decay of the surface potential).

EXAMPLE 2

An arc discharge type ion plating apparatus equipped with a resistance heating source and an electron beam heating means was used 99.99% purity Si was put in a first crucible, and Ti was put in a second crucible. The vacuum chamber was evacuated to $10^{-4}$ Pa by means of an oil diffusion pump, and Si and Ti were simultaneously vaporized by using two 3 kW electron guns while heating a thermionic filament to emit thermions of about 60 A. Ionization was conducted at an ionizing electrode voltage of 60 V.

$N_2$ was introduced from the lower part of the thermionemitting electrode, and the pressure was set at $6\times10^{-2}$ Pa. The ionized Ti and Si were thus reacted with $N_2$ to form a 8 μm thick charge transporting layer containing Ti and mainly comprising SiN on a 1 mm thick stainless steel substrate to which a bias of −500 V was applied.

The substrate having thereon the charge transporting layer was taken out of the vacuum chamber and set in a parallel plate type plasma CVD apparatus. Subsequently, the chamber was evacuated, and a charge generating layer and a surface layer were formed on the charge transporting layer under the same conditions as in Example 1.

When the resulting electrophotographic photoreceptor was charged to +6 kV with a corotron discharger, a surface potential of 450 V was maintained. A residual potential after exposure to light of 500 nm was 15 V.

EXAMPLE 3

The same ion plating apparatus as used in Example 2 was used. A mixed powder comprising $SiO_2$ and 5% by weight of Cu was put in a crucible. Oxygen gas was introduced into the chamber, and the pressure was set at $6\times10^{-2}$ Pa. The starting mixed powder was vaporized and ionized under conditions of 2 kW in power of the electron gun, 100 mA in ionization current, and −200 V in bias applied to a substrate to form a 10 μm thick Cu-containing $SiO_x$ film on an aluminum substrate kept at 200° C.

The substrate having thereon the charge transporting layer was taken out of the vacuum chamber and set in a parallel plate type plasma CVD apparatus. The chamber was evacuated, and a charge generating layer and a surface layer were formed thereon under the same conditions as in Example 1.

When the resulting electrophotographic photoreceptor was charged to +6 kV with a corotron discharger, an initial surface potential of 400 V was maintained. A residual potential after exposure to light of 500 nm was 20 V.

EXAMPLE 4

An arc discharge type ion plating apparatus equipped with a resistance heating source and an electron beam heating means was used. 99.99% purity Si was put in a crucible for resistance heating, and Ti was put in a center crucible. The vacuum chamber was evacuated to $10^{-4}$ Pa by means of an oil diffusion pump, and Ti was vaporized by using a 3 kW electron gun while vaporizing Si by resistance heating. A thermionic filament was heated to emit thermions of about 60 A. Ionization was conducted at an ionizing electrode voltage of 50 V.

$C_2H_2$ was introduced from the lower part of the thermionic emitting electrode, and the pressure was set at $2\times10^{-2}$ Pa. The ionized Ti and Si were thus reacted with $C_2H_2$ to form a 8.5 μm thick charge transporting layer containing Ti and mainly comprising SiC on a 1 mm thick stainless steel substrate to which a bias of −500 V was applied.

The substrate having thereon the charge transporting layer was taken out of the vacuum chamber and set in a parallel plate type plasma CVD apparatus. The chamber was evacuated, and a charge generating layer and a surface layer were formed under the same conditions as in Example 1.

When the resulting electrophotographic photoreceptor was charged to +6 kV with a corotron discharger, an initial surface potential of 450 V was maintained. A residual potential after exposure to light of 500 nm was 20 V.

As described above, the charge transporting layer according to the present invention, comprising silicon oxide, silicon carbide, silicon nitride or a mixture of two or more thereof and containing a transition metal element, exhibits satisfactory adhesion between layers, high mechanical strength and hardness while being free from defects. Accordingly, the electrophotographic photoreceptor using such a charge transporting layer has high durability, high sensitivity, superior panchromatic properties, high chargeability, small dark decay, and low residual potential after exposure. Moreover, the photoreceptor of the present invention is employable in printing systems using coherent light as a light source, such as an infrared semi-conductor laser, and provides a high quality image while preventing occurrence of an interference fringe in a laser printer.

While the invention has been described in detail and with reference to specific examples thereof, it will be apparent to one skilled in the art that various changes and modifications can be made therein without departing from the spirit and scope thereof.

We claim:

1. An electrophotographic photoreceptor essentially comprising a substrate having thereon a charge transporting layer and a charge generating layer, wherein said charge transporting layer comprises at least one of silicon oxide, silicon carbide, and silicon nitride and contains a transition metal element, wherein said transition metal element is present in an amount of from 0.01 to 30 at. % based on silicon.

2. An electrophotographic photoreceptor as claimed in claim 1, wherein said transition metal element is selected from 3*d*, 4*d*, and 5*d* transition metal elements.

3. An electrophotographic photoreceptor as claimed in claim 1, wherein said transition metal element is selected from the group consisting of Sc, Ti, V, Cr, Mn, Fe, Co, Ni, Cu, and Zn.

4. An electrophotographic photoreceptor as claimed in claim 1, wherein said charge transporting layer has an electrical resistance of from $10^{11}$ to $10^{16}$ Ω.cm.

5. An electrophotographic photoreceptor as claimed in claim 1, wherein said silicon oxide has an oxygen to silicon atomic ratio of from 0.1 to 2.0.

6. An electrophotographic photoreceptor as claimed in claim 1, wherein said silicon carbonate has a carbon to silicon atomic ratio of from 0.05 to 1.0.

7. An electrophotographic photoreceptor as claimed in claim 1, wherein said silicon nitride has a nitrogen to silicon atomic ratio of from 0.1 to 1.3.

* * * * *